US010221556B2

(12) United States Patent
Noble

(10) Patent No.: US 10,221,556 B2
(45) Date of Patent: Mar. 5, 2019

(54) PORTABLE BUILDING STRUCTURES

(71) Applicant: Noble Environmental Technologies Corporation, San Diego, CA (US)

(72) Inventor: Robert Noble, Encinitas, CA (US)

(73) Assignee: NOBLE ENVIRONMENTAL TECHNOLOGIES CORPORATION, San Diego, CA (US)

( * ) Notice: Subject to any disclaimer, the term of this patent is extended or adjusted under 35 U.S.C. 154(b) by 0 days.

(21) Appl. No.: 14/226,641

(22) Filed: Mar. 26, 2014

(65) Prior Publication Data

US 2015/0000216 A1 Jan. 1, 2015

Related U.S. Application Data

(60) Provisional application No. 61/841,207, filed on Jun. 28, 2013.

(51) Int. Cl.

| | |
|---|---|
| ***E04B 1/32*** | (2006.01) |
| *E04H 1/12* | (2006.01) |
| *E04H 3/08* | (2006.01) |

(52) U.S. Cl.

CPC ..... *E04B 1/3211* (2013.01); *E04B 1/3205* (2013.01); *E04B 2001/3276* (2013.01); *E04H 1/12* (2013.01); *E04H 3/08* (2013.01)

(58) Field of Classification Search

CPC ..... E04B 1/32; E04B 1/3211; E04B 1/3223; E04B 2001/3217; E04B 2001/3241; E04B 1/3241; E04B 1/3205; E04B 7/10; E04B 7/08; E04B 7/028; E04B 2001/3276; E04H 1/12

USPC ..... 52/80.1, 80.2, 81.1, 81.3, 81.4, 81.5, 52/582.1, 200, 745.08, 639, 644, 82, 81.6

See application file for complete search history.

(56) References Cited

U.S. PATENT DOCUMENTS

| | | | | |
|---|---|---|---|---|
| 2,372,187 A | | 3/1945 | Davison | |
| 2,460,662 A | | 2/1949 | Van Voorhis | |
| 3,300,923 A | | 1/1967 | Behlen | |
| 3,648,420 A | | 3/1972 | Nelson | |
| 3,763,608 A | * | 10/1973 | Chamlee | E04B 1/3211 52/469 |

(Continued)

FOREIGN PATENT DOCUMENTS

| | | |
|---|---|---|
| FR | 864795 A | 5/1941 |
| JP | 2004-278150 | 10/2004 |
| WO | WO 98/49403 | 11/1998 |

OTHER PUBLICATIONS

U.S. Appl. No. 60/045,145, filed Apr. 30, 1997, Noble et al.

WO, PCT/US2014/031916 ISR and Written Opinion, dated Aug. 27, 2014.

*Primary Examiner* — Chi Q Nguyen

(74) *Attorney, Agent, or Firm* — Brook Law Group, P.C.

(57) ABSTRACT

A portable modular building structure that includes a plurality of sections assembled adjacent one another. The sections include molded fiberboard panels, that optionally include interior plenums. In an embodiment, each panel has an upwardly curving profile, and mirror-image sections are attached to one another via a fastener, that may include tape or other mechanical fastener. The sections are positioned end to end, with the number of sections determining the overall length of the structure. An optional end section of the structure may include wedge shaped sections positioned end to end, forming a curved end.

7 Claims, 15 Drawing Sheets

(56) References Cited

U.S. PATENT DOCUMENTS 3,894,367 A * 7/1975 Yacoboni ..... E04B 1/3211 52/81.2
3,902,288 A 9/1975 Knudson
3,999,337 A * 12/1976 Tomassetti et al. ..... 52/82
4,023,317 A 5/1977 Bettger et al.
4,068,423 A 1/1978 Marsh
4,075,795 A * 2/1978 Thomas ..... E04H 14/00 52/65
4,133,150 A * 1/1979 Yacoboni ..... 52/81.2
4,146,997 A * 4/1979 Diethorn ..... 52/81.4
4,324,074 A * 4/1982 South et al. ..... 52/2.15
4,400,927 A * 8/1983 Wolde-Tinase ..... 52/745.08
4,488,392 A * 12/1984 Pearcey ..... E04B 1/3211 264/32
4,655,013 A * 4/1987 Ritland ..... E04B 1/14 52/127.9
4,663,898 A * 5/1987 Yacaboni ..... 52/82
4,698,941 A * 10/1987 Rieder et al. ..... 52/81.3
4,702,870 A 10/1987 Setterholm et al.
4,720,947 A * 1/1988 Yacaboni ..... 52/81.3
4,753,713 A 6/1988 Gunderson
4,784,172 A * 11/1988 Yacoboni ..... E04B 1/3211 135/87
4,848,046 A * 7/1989 Wallhead ..... E04H 9/16 52/81.4
5,198,236 A 3/1993 Gunderson et al.
5,277,854 A 1/1994 Hunt
5,313,763 A * 5/1994 Oram ..... 52/80.2
5,314,654 A 5/1994 Gunderson et al.
5,706,620 A 1/1998 De Zen
5,724,775 A * 3/1998 Zobel et al. ..... 52/82
5,771,649 A * 6/1998 Zweig ..... E04B 1/16 52/233
6,324,791 B1 * 12/2001 Azpiroz Villar ..... 52/80.1
7,152,384 B1 * 12/2006 McCarty ..... 52/639
7,237,363 B2 * 7/2007 Wilson ..... 52/80.1
7,882,660 B2 * 2/2011 Kitagawa ..... 52/81.1
8,297,027 B2 10/2012 Noble et al.
8,307,605 B2 * 11/2012 McCarty ..... E04B 7/08 52/745.07
8,475,894 B2 7/2013 Noble et al.
8,720,091 B1 * 5/2014 Snyder ..... G09F 15/02 211/163
2005/0210767 A1 * 9/2005 DeFever et al. ..... 52/80.1
2008/0236057 A1 * 10/2008 McCarty ..... 52/80.1
2012/0204496 A1 * 8/2012 McSweeney ..... E04B 1/3211 52/80.1
2014/0283473 A1 * 9/2014 Yoo ..... E04C 3/29 52/309.15
2014/0345207 A1 * 11/2014 Gliessman ..... 52/80.1

* cited by examiner

PORTABLE BUILDING STRUCTURES

CROSS-REFERENCE TO RELATED APPLICATION

This application claims priority to U.S. application No. 61/841,207, entitled, "Portable Building Structures", and which was filed Jun. 28, 2013, the entirety of which is referred to and incorporated herein by this reference in its entirety.

FIELD OF THE DISCLOSURE

The disclosure that follows relates to modular structural assemblies.

BACKGROUND

Modular building is a technique of construction of temporary or permanent structures, such as construction camps, schools, classrooms, community centers, disaster relief housing, civilian or military housing, and industrial facilities. It is also highly desirable in remote areas where conventional construction techniques may be unavailable or unfeasible due to lack of resources, construction crews, or difficult access.

There are many known disadvantages of traditional site-built structures, that may be addressed by a highly mobile and cost effective modular building technique. For example, site-built structures are typically constructed from concrete, metal and wood. Increased or prohibitive costs may be involved in transporting the building materials and construction workers to the build site. Use of concrete requires the materials to be mixed and poured at the job site by a concrete mixing truck. Concrete is also prone to cracking due to thermal stresses and seismic activity. Likewise wood building materials often need to be suitably stored at the construction site, and for larger beams, whether wood or metal, heavy duty transportation or handling may be required. In addition, wood structures can be susceptible to infestation by pests, such as termites and mice. Wood also can deteriorate due to environmental factors such as fungus or other rot. Furthermore, typical wood, metal and concrete structures cannot be readily disassembled and moved to a different location, leading to waste of building materials if the building becomes unneeded.

Accordingly, there is a need for an easily transportable and readily assembled pre-fabricated building structure and assembly technique. There is also a need for a building structure that can be disassembled and either re-used or recycled. Further, there is also a need for a building process that is flexible, fast and environmentally friendly.

SUMMARY

The present disclosure, in its many embodiments, alleviates to a great extent the disadvantages of known buildings and construction techniques by providing modular building elements, that are readily transportable, and can be assembled into a desired modular structure. In embodiments of the invention, the modular structures are buildable using a small crew with little or no construction expertise or specialized equipment. In one embodiment the structure is assembled by two installers, using construction tape, ladders and optionally fasteners such as bolts or screws.

In an embodiment, the building elements of the modular structures are made from a fiberboard material system, such as formed from molded and/or compressed cellulosic based materials, and formed into generally sections. The sections can be sized to be loadable onto the back of a pickup truck and transportable to remote locations for assembly. In an opposed panel embodiment, the panels have approximately quarter circle cross sections, with a base aligned at ground and a joint end close to or contacting an opposing panel. The panels are affixed to one another at the contact seam using tape, and optionally a positioning block, or biscuit, that optionally also can receive a fastener. In this way, the connection ends of each panel are fastened at a joint such that the two panels form a section with a 180 degree arch.

The panels can be attached at a seam or joint through a variety of fasteners or even held together with no fastener. In the embodiment where no fastener is used, the panels remain connected by their opposing moment forces. In the embodiments with fasteners, adhesive tape or a biscuit can be used to secure the panels together at the joint. For adhesive tape, it is desirable that the length of the tape match the width of the panel to provide greater stabilization at the seam.

The sections may be connected to one another to provide an elongated, rectangular modular structure. There is no limit on how many sections can be stacked lengthwise. The interior of the panels have a corrugated or truss structure, providing longitudinally extending voids or a plenum. In one embodiment, electrical plumbing is threaded through the plenum. In another embodiment, lighting is attached to the electrical plumbing to provide lighting to the interior of the structure. In addition, the internal, longitudinally extending voids also optionally may be used for mechanical elements, such as conduits, wiring, ventilation ducts, water, plumbing or any other construction purpose that requires a plenum or conduit.

In another embodiment of the invention, a plurality of pie-shaped curved panels made from molded fiberboard are joined together at an assembly joint, and the sides of the panels are connected to one another in the shape of an igloo. The assembly joint is typically a compression ring, and is selected for its capability in absorbing horizontal force exerted on it. In one embodiment, the compression ring is hollow, allowing for a skylight to be placed over it. Optionally, objects may be attached to the panels, such as a solar panel with batteries. In other embodiments, windows and doors may be added to elongated structures and the igloo-type structures using resins, adhesives or mechanical fasteners.

Various configurations of the modular structures are possible. In one embodiment, an elongated structure is attached to a half-igloo structure. In another embodiment, two half-igloo structures are attached at opposite ends of an elongated structure. In still another embodiment, no igloo is attached to the modular structure.

A notable advantage of the present invention is its portability. Each panel can be lifted by a single person and placed onto the back of a pick-up truck. Another notable advantage is the ease of disassembly of the modular structure. The materials are completely recyclable and reusable, only requiring new adhesive tape to connect the recycled panels. In some cases, however, the tape may be reused.

Other objects and advantages of the present invention will become more obvious hereinafter in the specification and drawings.

BRIEF DESCRIPTION OF THE DRAWINGS

The foregoing and other objects of the disclosure will be apparent upon consideration of the following detailed description, taken in conjunction with the accompanying drawings, in which.

DETAILED DESCRIPTION

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations of the present disclosure. As used herein, the "present disclosure" or "present invention" refer to any one of the embodiments described herein, and any equivalents. Furthermore, reference to various aspects of the invention throughout this document does not mean that all claimed embodiments or methods must include the referenced aspects or features.

The modular structures of the present invention are formed by curved stressed-skin panels made from molded cellulose based materials. Examples of suitable molded and/or compressed cellulose based materials are discussed in commonly owned U.S. Pat. No. 8,297,027, entitled, "Engineered Molded Fiberboard Panels and Methods of Making and Using the Same" and U.S. Pat. No. 8,475,894, entitled, "Engineered Molded Fiberboard Panels, Methods of Making the Panels, and Product Fabricated From the Panels," both of which are referred to and incorporated herein in their entireties.

The basic configurations for panels used in the present invention can be formed in accordance with methods established in prior art, such as embodied in U.S. Pat. Nos. 4,702,870; 4,753,713; 5,198,236; 5,277,854; 5,314,654, and PCT Application No. US98/08495, the entire disclosures of which are incorporated herein by reference.

Figure 1:
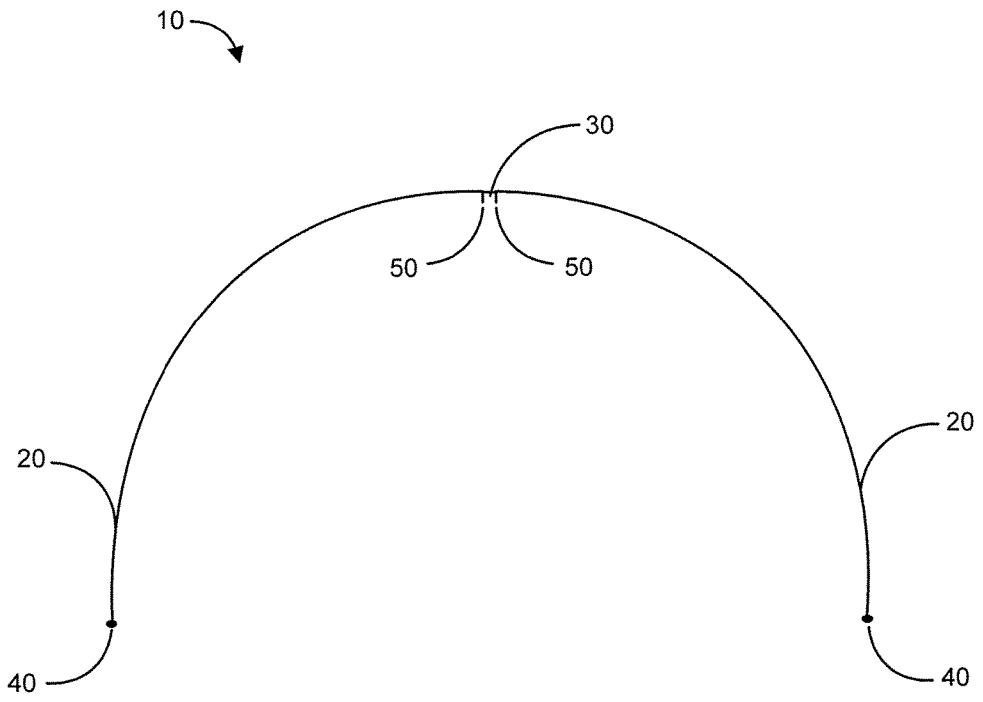
FIG. 1 is an elevation view of two connected curved panels in accordance with the invention.

A two-piece section 10 is illustrated in FIG. 1. A single-piece panel 20 is shown that forms a 90 arc from its bottom end 40 to its top end 50. The bottom end 40 of single-piece panel 20 contacts the ground. The top end 50 of the single-piece panel 20 contacts an opposing top end 50 of a second single-piece panel 20. The bottom end 40 of the second single-panel 20 also contacts the ground. As shown, the two single-piece panels 20 are connected together such that they form a section, or a 180 degree arch over the ground.

Figure 2:
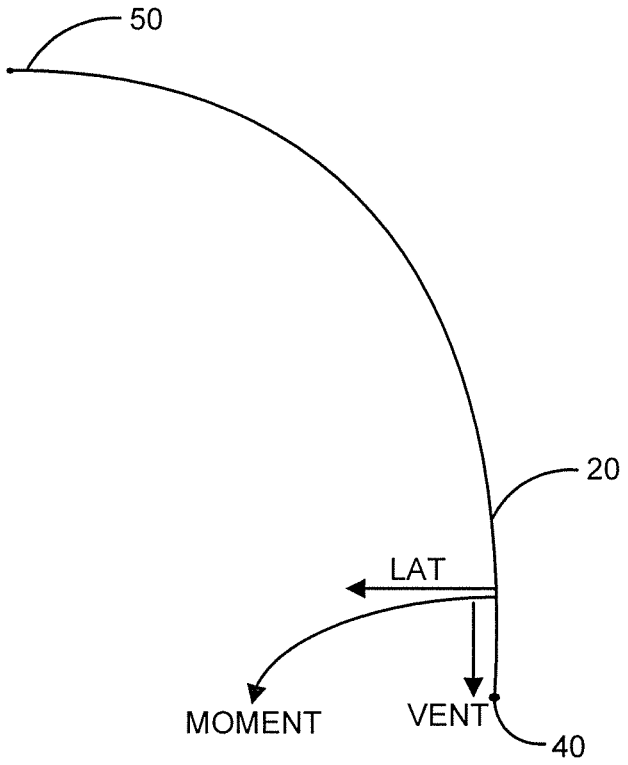
FIG. 2 is an elevation view of a single curved panel showing the forces exerted on it.

The top ends 50 of the two single panels 20 form a joint or seam 30 at their point of contact. The panels 20 can be attached at seam 30 using a variety of methods. For example, the curved panels can be attached with no fastener. In this instance, the weight of the two single-panels 20 pressing against one another at their respective top ends 50 acts as a counterbalance to one another. As shown in FIG. 2, single-piece panel 20 has a moment of force or torque. The torque is defined as the force acting at a perpendicular distance and causing an object to rotate. The moment of force typically pivots around a point. Here, the pivot point is the bottom end 40 of single panel 20. The force is a product of the mass of the single panel 20 and gravity.

The moment of force applied to the beam is comprised of two force components—a lateral force and a vertical force. The lateral force from a single panel 20 meets an opposing, yet equal lateral force from a second panel at seam 30. These two lateral forces of the two opposing panels 20 cancel one another and hold together the panels at seam 30 without the use of any additional fastening device. The other force component, the vertical force, is not canceled. Instead, it combines with the vertical force of an opposing single panel. In cases where the combined vertical forces are large, bowing at seam 30 may occur.

Figure 3:
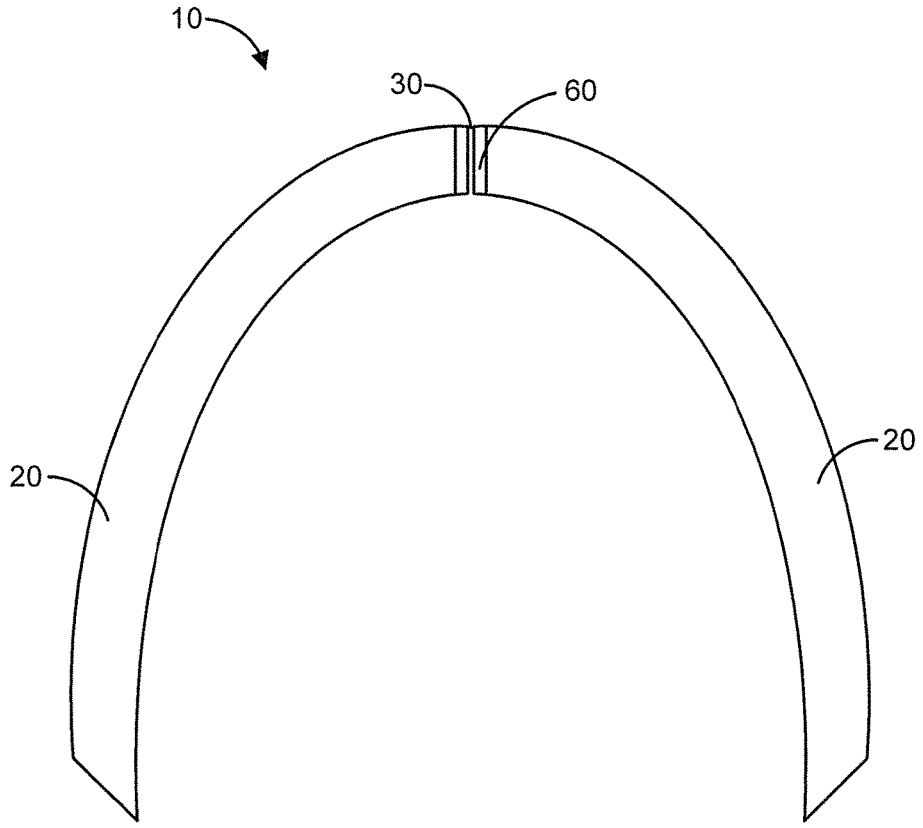
FIG. 3 is a perspective view of two connected curved panels in accordance with the invention.

Fasteners may be incorporated at seam 30 to connect the two single-panels 20 into section 10. In FIG. 3, adhesive tape 60 is optionally applied at seam 30 on the bottom side and top side. It is desirable for the adhesive tape 60 to cover the entire width of the panel. This maximizes the surface area of the panels that is being secured together at seam 30. Obviously, by matching the width of the panel to the length of the adhesive tape, section 10 has improved stabilization. In addition, adhesive tape 60 provides the structure with weather resistant qualities.

For example, in an exemplary embodiment, single panel 20 is two feet in width. To match the width of the panel, two feet of adhesive tape 60 should be applied at seam 30. The panels can be wider than two feet, depending on the structural requirements of the modular assembly. However, the width of panel chosen should not negatively impact the transportable nature and ease of assembly of the panels. It is desirable that the panel have a width that the average person can grasp with two hands. It is also desirable that one person on a ladder be able to apply adhesive tape 60 at seam 30 to connect the panels 20.

Figure 4:
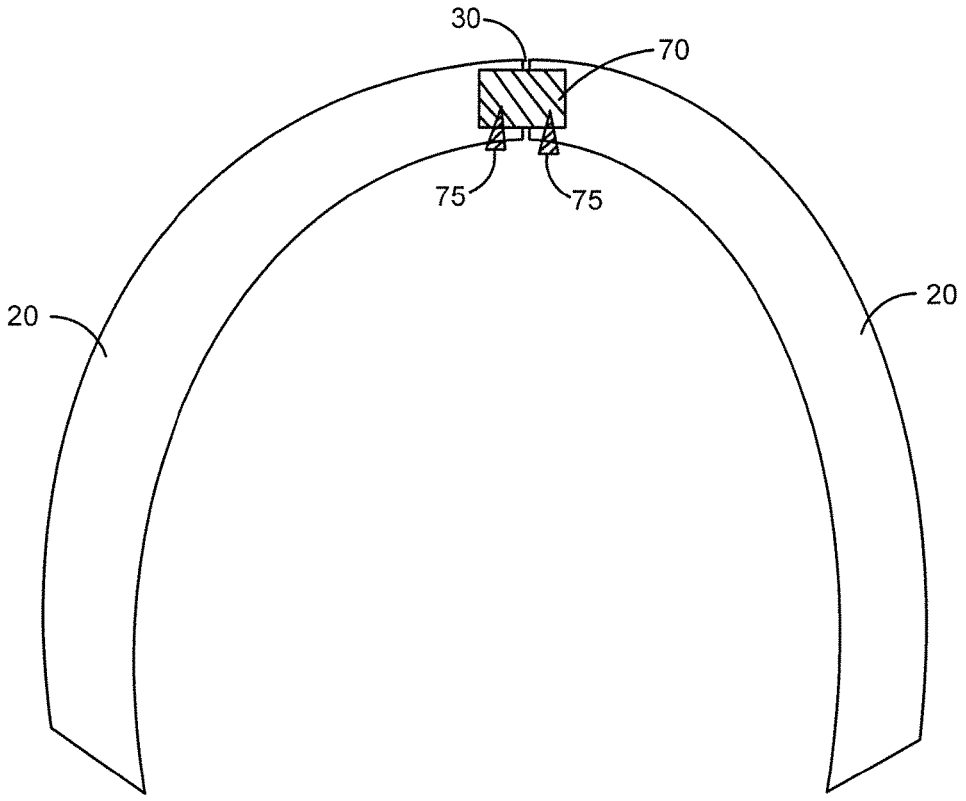
FIG. 4 is a perspective view of two connected curved panels in accordance with the invention.

In addition to adhesive tape, a mechanical fastener may be used to secure the panels 20 together at seam 30. In the exemplary embodiment illustrated in FIG. 4, biscuit 70 is located inside the panels 20 at seam 30. Biscuits are commonly used to align edges of panels, such as when forming a 90 degree angle between panels. The biscuit 70 provides a means of getting a perfectly flush joint, while at the same time reinforcing the connection at seam 30. Biscuit 70 is bolted 75 in place from the bottom side of the panels 20.

Figure 5:
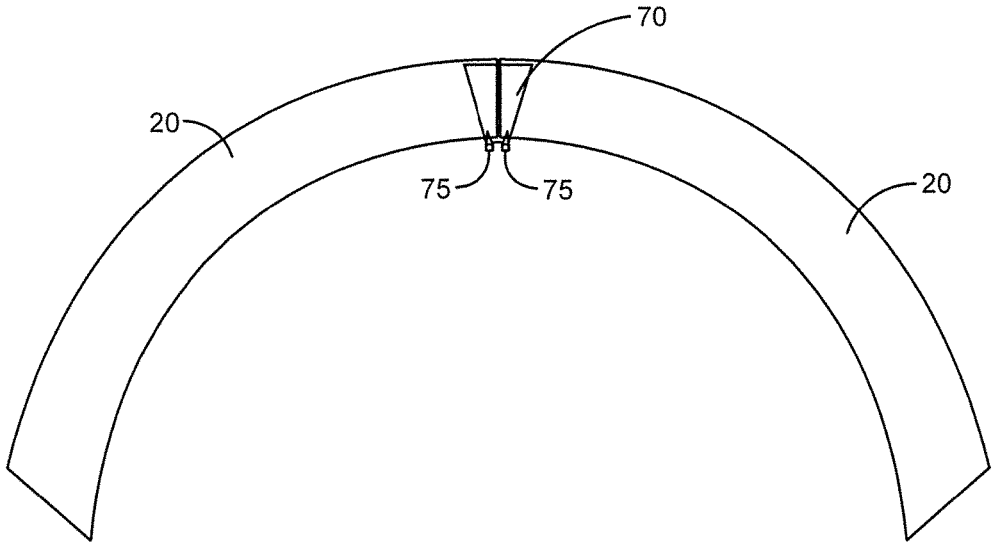
FIG. 5 is a perspective view of two connected curved panels in accordance with the invention.

Illustrated in FIG. 5 is an exemplary embodiment showing an alternative biscuit 70 design to secure panels 20 together at seam 30. Biscuit 70 is shaped in the form of a trapezoid and is located in seam 30. The trapezoidal biscuit 70 extends outside the bottom side of panels 20. The trapezoidal biscuit 70 is bolted 75 in place on the bottom side of panels 20. It should be appreciated that in both of the exemplary embodiments illustrated in FIGS. 4 and 5, biscuit 70 is hidden from external view for cosmetic purposes.

Figure 6:
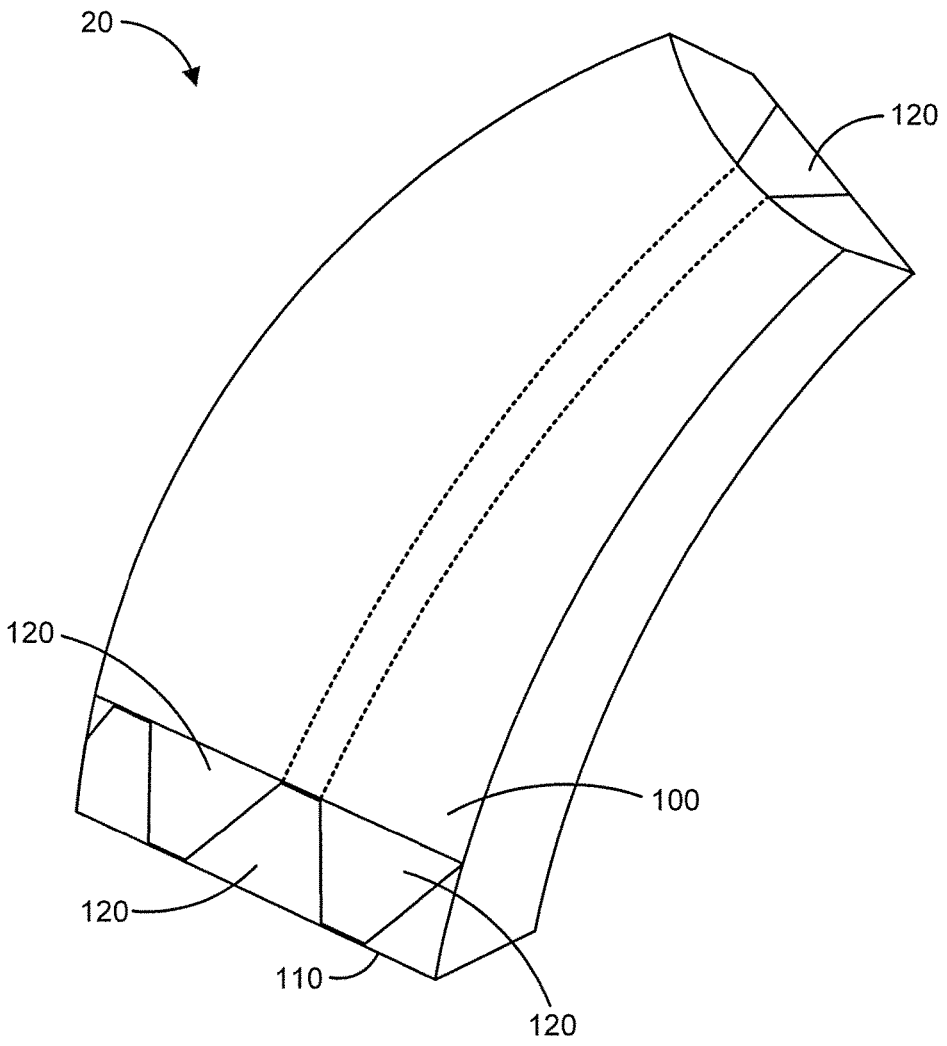
FIG. 6 is a perspective view of a curved panel in accordance with the invention.

It should be noted that panel 20 may have a corrugated or truss internal structure, providing longitudinally extending voids 120 within the structure. It should be further noted that panel 20 may optionally have a honeycomb internal structure. In the illustrated embodiment shown in FIG. 6, panel 20 includes opposing skins, which are called for naming purposes not limitation, a top or outer skin panel 100 and a bottom or inner skin panel 110. The outer skin panels 100 form the outer or upper surfaces of each of the panels 20. The bottom skin panel 110 forms the inner or lower surfaces of the panel 20. Optionally, the top and bottom panels, or a subset thereof, may be formed of molded and/or compressed cellulose based materials, although any suitable material may be selected.

In the illustrated example, single panel 20 is shown from a perspective view. Longitudinally extending void spaces between the outer and inner skin panels 100, 110 are indicated with reference number 120. It should be noted that any interior structure may be used, not just a corrugated structure as illustrated, and accordingly, any shaped void spaces may be created. In one embodiment it is desired that at least one of the void spaces 120 extends longitudinally for the entire length or a desired portion of the entire length of the panel 20. In an alternative embodiment, the corrugated internal structure and void space 120 may run crosswise through the width of the panel 20, as opposed to longitudinally over the length of the panel.

Figure 7:
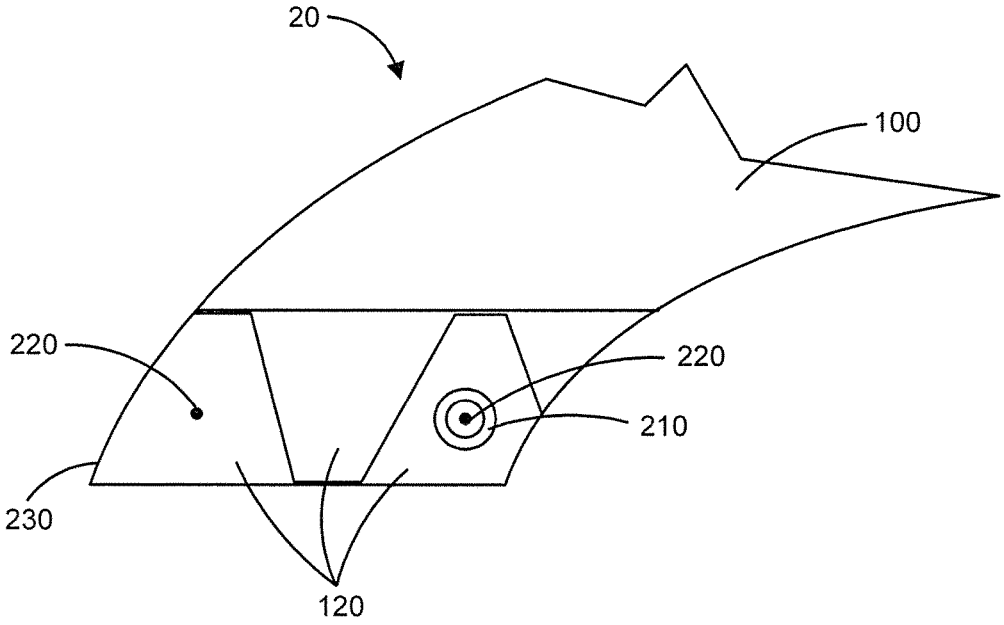
FIG. 7 is a perspective view of a partial curved panel in accordance with the invention.

Optionally mechanical or electrical elements may be positioned within one or more of the void spaces 120. Examples of such mechanical or electrical elements may include ventilation ducts, wires, lighting, cables, plumbing or conduits. In the embodiment illustrated in FIG. 7, a longitudinally extending conduit 210 is provided along with a cable 220 threaded through the conduit 210. In some embodiments element 210 extends the full length of section 10 which includes panel 20 through seam 30 into connected panel 20. In this embodiment, void spaces 120 should align between the two connected panels 20 so the conduit 210 and the mechanical or electrical element 220 pass through without obstruction.

In other embodiments, the mechanical or electrical element may enter at end 230, but have an intermediate access or egress port that enables access into the interior of the panel 20 at a point intermediate of the respective ends. In an alternate embodiment, there are two or multiple intermediate access or egress ports. The ports may be positioned either on outer or inner sides of the panel 20, or on outer or inner sides of alternate structures as well. In an alternate embodiment, as illustrated in void 120 on far left side of FIG. 7, the void(s) 120 may be used to pass through a mechanical or electrical element 220 without the insertion of an additional mechanical conduit 210.

Figure 8:
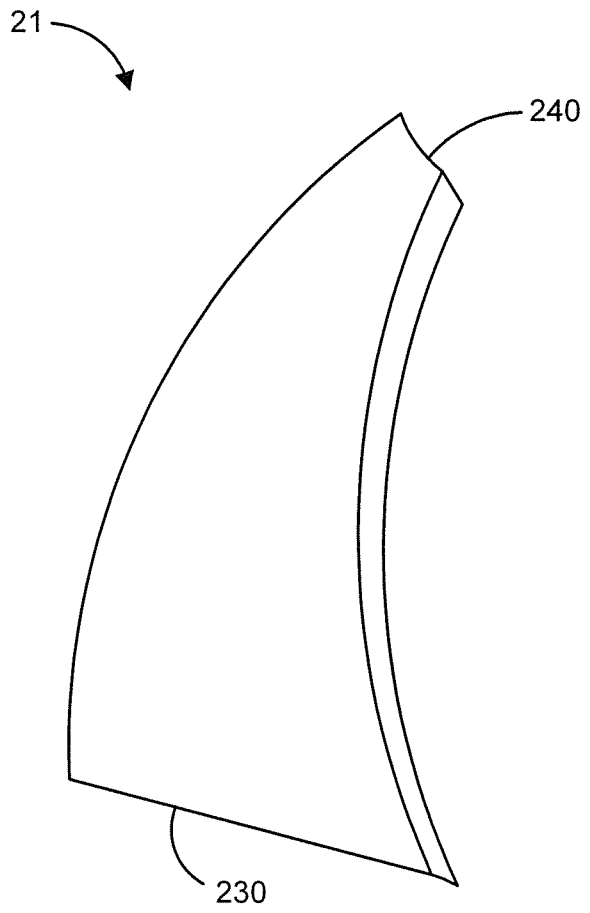
FIG. 8 is a perspective view of a curved panel in accordance with the invention.
Figure 9:
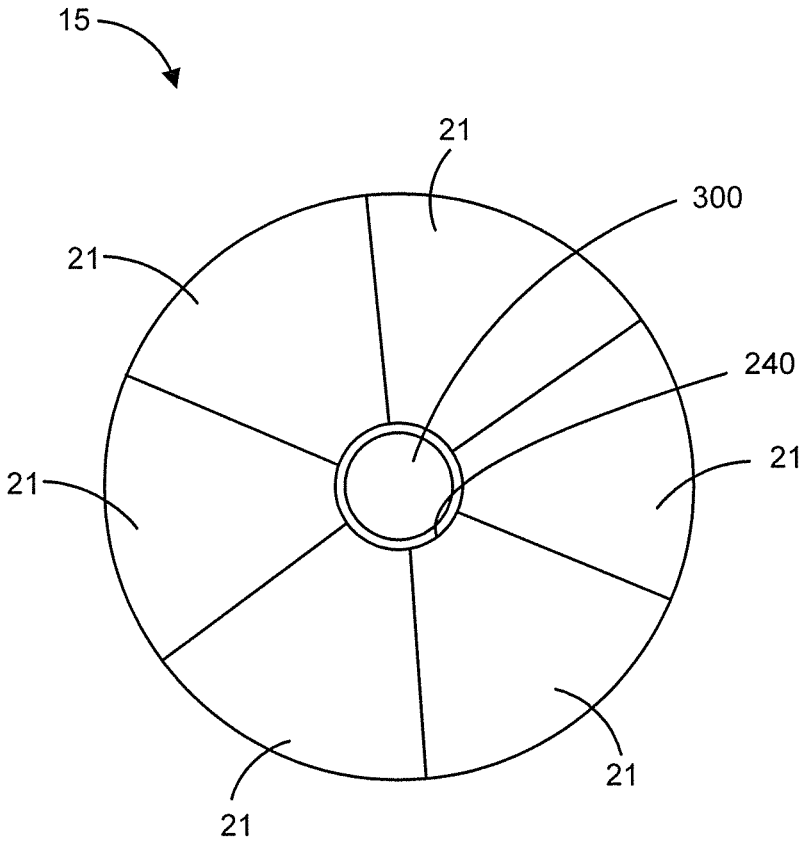
FIG. 9 is a plan view in accordance with the invention.

Many different modular structures are possible. FIG. 8 illustrates a panel 21 in a pie shaped configuration. It should be noted that the material at end 240 of the panel 21 has been removed. This allows for attachment of panel 21 into an assembled structure with the sides of each panel 21 connected to one another and forming an "igloo" configuration 15, as shown in FIG. 9. In this embodiment, panels 21 are aligned and held together by a compression post or ring 300. The compression post or ring 300 is capable of absorbing the horizontal forces exerted on it by the panels 21.

It is known in the art that compression posts or rings are useful in assemblies that may require occasional disassembly or partial removal for maintenance etc., since these joints can be broken and remade without affecting the integrity of the panels 21. Compression posts or rings are also desirable because they do not require soldering, so they are comparatively quick and easy to use. Further, they require no special tools or skills to operate and work at higher pressures.

Figure 10A:
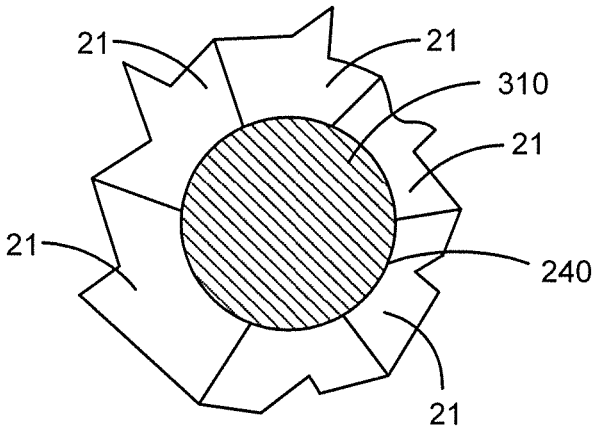
FIG. 10A is a top plan view in accordance with the invention.
Figure 10B:
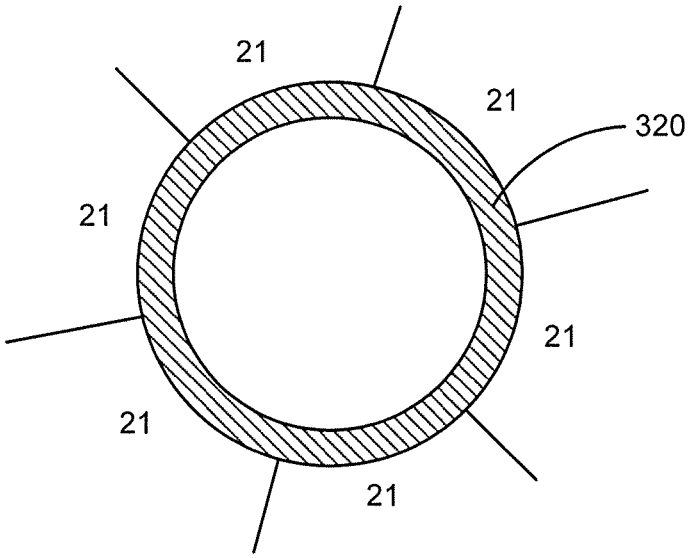
FIG. 10B is a top plan view in accordance with the invention.

Different styles of compression rings may be used in the present invention. In one embodiment, a solid compression ring or plug 310 may be used at the joint to align and assemble the panels into a modular structure, as shown in FIG. 10A. In the alternative embodiment shown in FIG. 10B, a hollow compression ring 320 may be used as the joint to align and assemble the panels 21 into a modular structure. Selection on the type of compression ring depends upon the mechanical and physical features desired in the assembled structure. In addition, the environment in which the modular structure will be placed may be a factor in the selection of the compression ring. Hotter environments or moist conditions may cause greater expansion and contraction of the Engineered Molded Fiberboard Panels. In that case, a compression ring should be selected that is capable of absorbing the expansion and contraction of the material without causing damage to the materials or the assembly joint.

Figure 11:
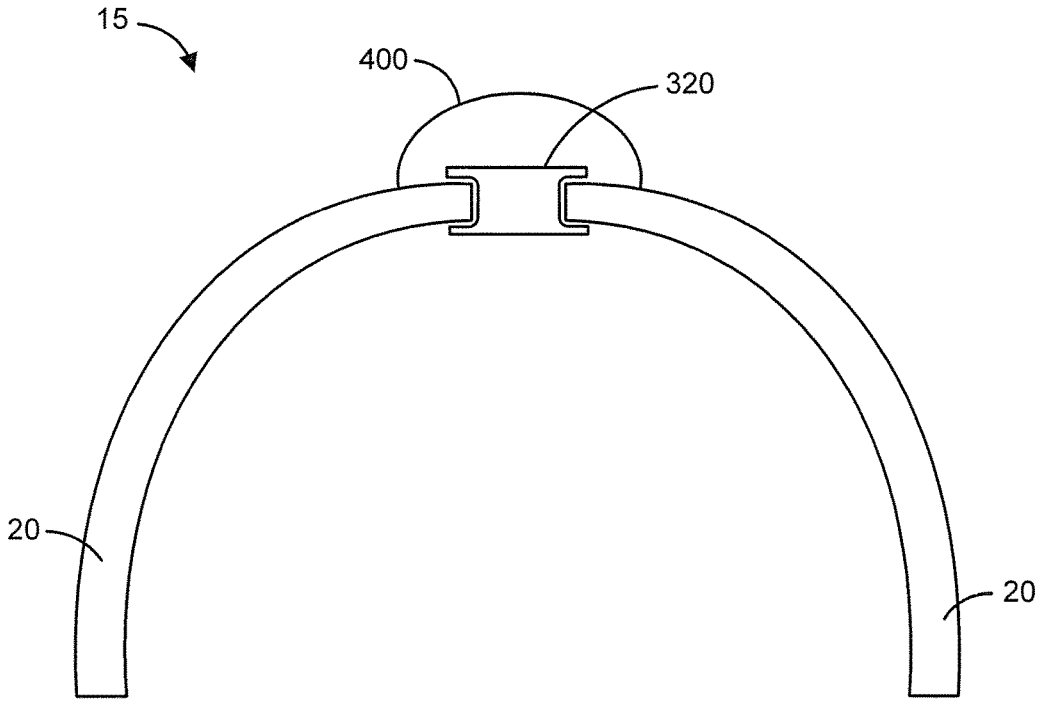
FIG. 11 is an elevation view in accordance with the invention.

It should be noted that a hollow ring 320 provides the additional advantage of an open roof in the modular structure to allow in natural light. Illustrated in FIG. 11 is an optional dome or skylight 400 placed over the hollow ring and attached to the top side of the panels 21. The optional dome or skylight 400 adds clean natural light to the modular structure 15 and may also enhance the appearance of the roofline of the structure. In an alternative embodiment, the ends 240 of each panel 21 are not removed, such that the assembled structure 15 has no openings at the compression ring 300. In this configuration, the modular structure has a closed roof, and will not allow natural light inside.

It should be appreciated that additional roof elements may be attached to the top side of the modular structure. For example, solar panels may be attached to the top side of the panels and wired through the void spaces in the Fiberboard Panels to bring electricity into the modular structure. This would be highly desirable when the modular structure is assembled in a remote location where electricity might not be available. If additional electrical power is desired or electrical storage is needed, solar panels with batteries may be attached to the top side of the modular structure and wired through the void spaces in the Fiberboard Panels.

It should be further appreciated that additions may be made to the sidewalls of the modular structure. For example, windows or doors may added. Other cosmetic features may also be added such as molding or a transom lights to beautify the structure.

A resin or adhesive binder may be used to attach the skylight, solar panels and windows to the panels. The resin or adhesive binder should be selected to provide desirable features such as water resistance and thermal resistance at the seal. Mechanical fasteners, such as bolts, may also be used to attach these desirable objects to the structure.

Figure 15:
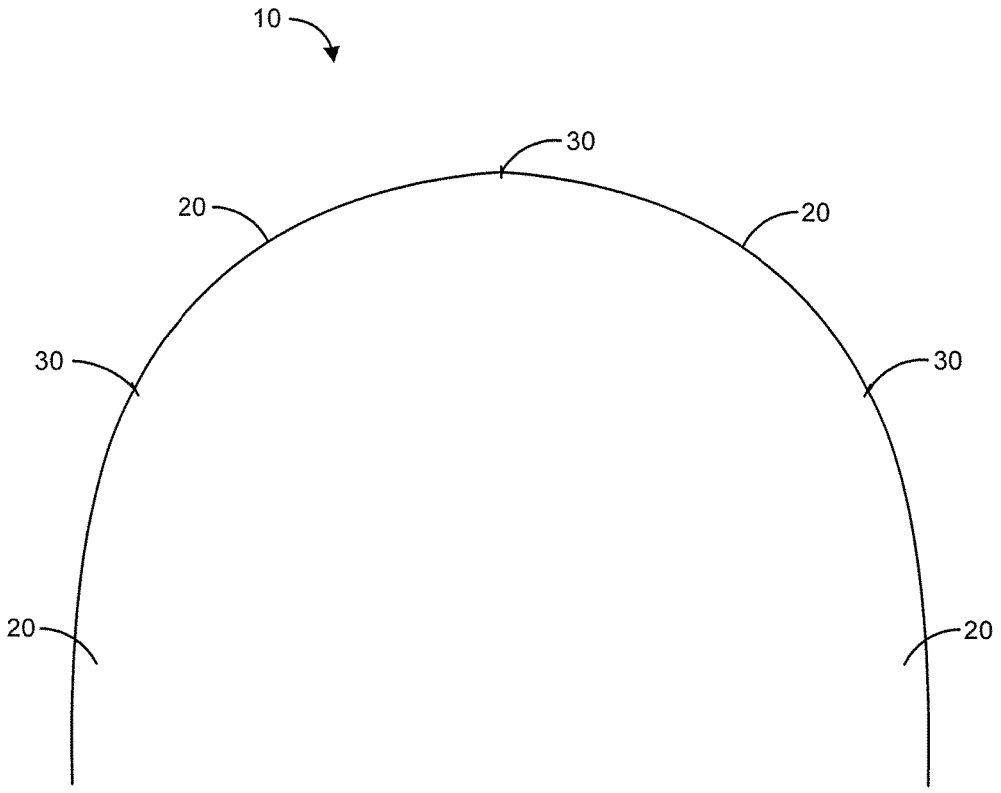
FIG. 15 is an elevation view of four connected curved panels in accordance with the invention.

It should be appreciated that any shape of modular structure can be created with the present invention. A minimum of two panels creates a semi-circle arch 10. However, if a taller structure is desired, then four panels 20 may be used to construct the semi-circle arch 10 as illustrated in FIG. 15. In this embodiment, each panel has a 45 degree arc, as opposed to the 90 degree arcs in the two panel configuration shown in FIG. 1. In addition, the four panel configuration has three connection points or seams 30.

Figure 12:
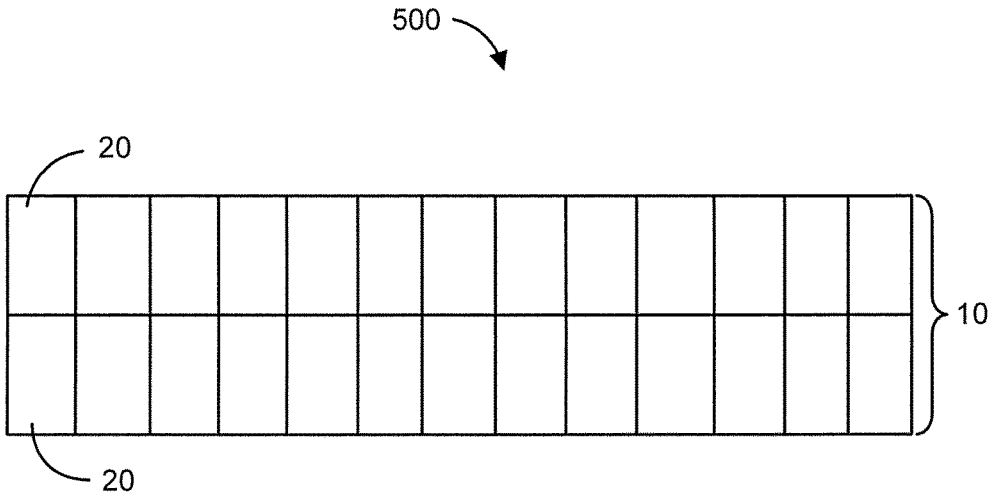
FIG. 12 is a plan view in accordance with the invention.

Multiple iterations of sections can be combined to build more complex structures. FIG. 12 shows an elongated structure 500 that is constructed by stacking semi-circle sections 10 of panels 20 lengthwise. Sections 10 may be connected by the fasteners described earlier in this disclosure. Adhesive tape may also be applied continuously down the centerline of sections 10 to attach them and form elongated structure 500. Although this modular structure is similar in its final shape to the Quonset but type structure disclosed in PCT/US98/08495, the present invention erects this structure using a two-panel or four-panel cross-section as opposed to the three-panel cross-section described in PCT/US98/08495. It should be appreciated that the modular structure in FIG. 12 can be extended in length or reduced in length as much as desired by adding or subtracting semi-circle sections 10 from the modular structure 500.

Figure 13:
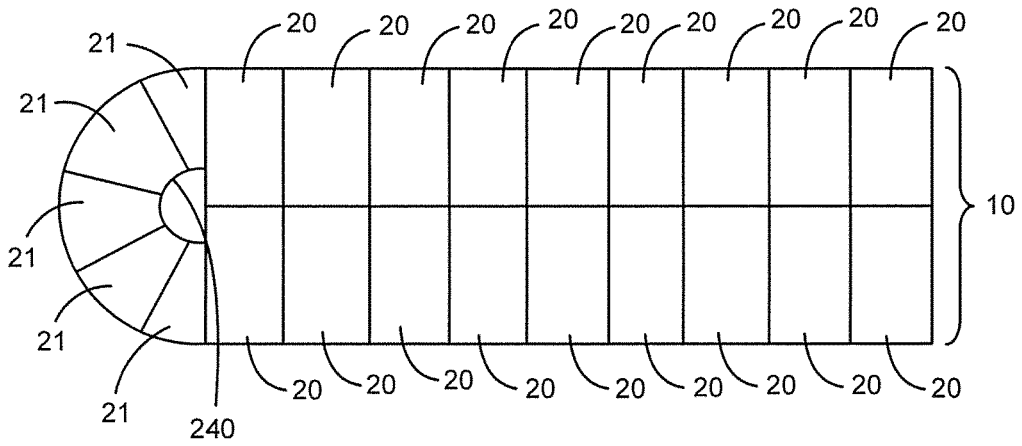
FIG. 13 is a plan view in accordance with the invention.

It should be appreciated that other footprints for the modular structures are possible by combining the shapes from the previously described figures. For example, in the embodiment shown in FIG. 13, half an igloo is connected to an elongated section. The half igloo section is comprised of pie-shaped panels 21. The elongated section is formed by stacking semi-circle sections 10 of panels 20 lengthwise. It should be noted that in this embodiment the material at end 240 of the panel 21 has been removed so an opening exists between the half-igloo and the elongated section.

Figure 14:
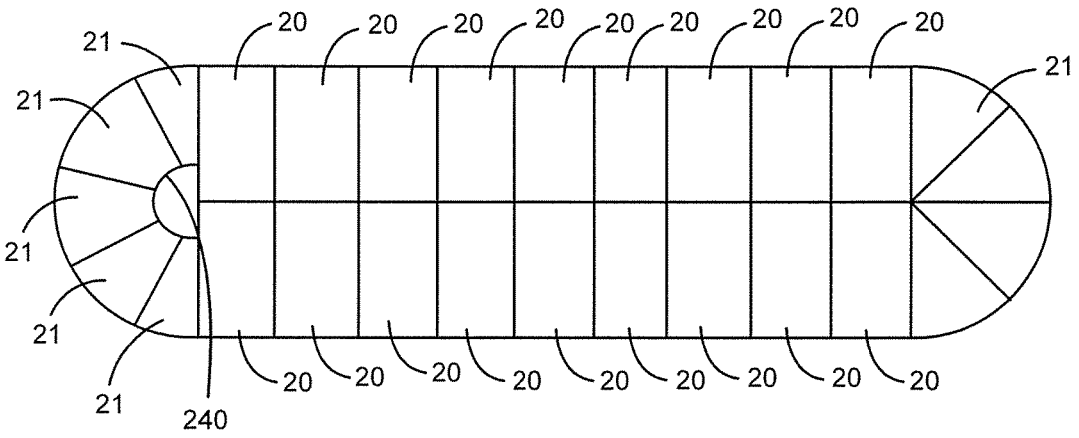
FIG. 14 is a plan view in accordance with the invention.

FIG. 14 shows another embodiment of the modular structure. In this embodiment, a half igloo is connected at one end of an elongated section with an opening between the half-igloo and the elongated section. A second half igloo is attached at the opposite end of the elongated section. The second-half igloo does not have material at end of panel 21 removed, so the structure is closed at this end of the elongated section. It should be appreciated that different combinations of closed or open half-igloos attached to the ends of the elongated sections are possible. The combination of half-igloos and elongated sections depends on the requirements of the modular structure.

A notable feature of the modular structure is its portability. Each panel can be lifted by two people, sometimes even by a single person, and placed onto the back of a pick-up truck. Multiple panels can fit in one truckload. After the truck has transported the panels to its desired location, each panel can be unloaded and assembled by two individuals, with the use of ladder and tape.

Another notable feature is the ease of disassembly of the modular structure. Simply remove the tape, unscrew the bolts, remove the sections of panels one at a time and load back onto the truck. The materials are completely recyclable and reusable to build a new modular structure. The only additional material needed would be new tape to connect the recycled panels.

Thus, it is seen that modular building structures made from fiberboard materials are provided. It should be understood that any of the foregoing configurations and specialized components or may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

What is claimed is:

1. A building structure positioned on a substrate surface, the building structure including a first section, the first section comprising:

A first curved panel having a wedge-shaped lateral profile, a first base end and a first connection end elevated above the first base end, the first curved panel including a curved molded fiberboard;

a second curved panel having a wedge-shaped lateral profile, a second base end and a second connection end elevated above the second base end, the second curved panel including a curved molded fiberboard;

a first fastener connecting the panels at the respective first and second connection ends, wherein, the first and second base ends are positioned adjacent the substrate surface and the fastened connection ends are elevated above the surface;

wherein the first fastener includes a generally semi-circular connector biscuit positioned inside both the first and second connection ends of the panels;

wherein the connector biscuit provides a flush joint between the two panels;

a third curved panel having a rectangular-shaped lateral profile, a third base end and a third connection end elevated above the third base end, the third curved panel defining a curvature matching a curvature of the first panel;

a fourth curved panel having a rectangular-shaped lateral profile, a fourth base end and a fourth connection end elevated above the fourth base end, the fourth curved panel defining a curvature matching a curvature of the second panel;

a second discrete fastener connecting the third and fourth panels at respective third and fourth connection ends, wherein, the third and fourth base ends are positioned adjacent the substrate surface and the fastened connection ends are elevated above the surface; and wherein the third panel is positioned adjacent the first panel and the fourth panel is positioned adjacent the second panel.

2. The building structure of claim 1, wherein the biscuit is bolted in place from the bottom side of the connection ends of the first and second panels.

3. The building structure of claim 1 further comprising a second section, the second section comprising:

a third curved panel having a third base end and a third connection end elevated above the third base, the third curved panel including a curved molded fiberboard and defining a curvature matching a curvature of the first panel;

a fourth curved panel having a fourth base end and a fourth connection end elevated above the fourth base, the fourth curved panel including a curved molded fiberboard and defining a curvature matching a curvature of the second panel;

a discrete second fastener connecting the third and fourth panels at the respective third and fourth connection ends, wherein, the third and fourth base ends are positioned adjacent the substrate surface and the fastened connection ends are elevated above the surface; and wherein the third panel is positioned adjacent the first panel and the fourth panel is positioned adjacent the second panel.

4. The building structure of claim 3 further comprising a discrete third fastener connecting the first panel to the third panel.

5. The building structure of claim 3 further comprising a fourth discrete fastener connecting the second panel to the fourth panel.

6. The building structure of claim 1 further comprising a plurality of sections in addition to the first section, each of the plurality of sections comprising:

a respective first section panel having a respective first section panel base end and a respective first section panel connection end, the respective first section panel defining a side profile corresponding to a side profile of the first curved panel of the first section;

a respective second section panel having a respective second base end and a respective second connection end, the respective second section panel defining a side profile corresponding to a side profile of the second curved panel of the first section;

wherein each respective first section panel is positioned adjacent at least one other of the first sections or adjacent the first curved panel, and each respective second section panel is positioned adjacent at least one other of the second sections or adjacent the second curved panel.

7. The building structure of claim 6, wherein the connected panels are aligned to create a plenum between the panels.

* * * * *